US009834978B2

(12) United States Patent
Nania

(10) Patent No.: US 9,834,978 B2
(45) Date of Patent: Dec. 5, 2017

(54) POWER DOOR SYSTEM FOR A MOTOR VEHICLE

(71) Applicant: FORD GLOBAL TECHNOLOGIES, LLC, Dearborn, MI (US)

(72) Inventor: Adrian Nania, Rochester, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/245,453

(22) Filed: Apr. 4, 2014

(65) Prior Publication Data

US 2015/0283886 A1 Oct. 8, 2015

(51) Int. Cl.
*E05F 15/04* (2006.01)
*E05F 15/73* (2015.01)
*E05F 15/622* (2015.01)

(52) U.S. Cl.
CPC ..... *E05F 15/73* (2015.01); *E05F 15/622* (2015.01); *E05Y 2400/44* (2013.01); *E05Y 2900/531* (2013.01)

(58) Field of Classification Search
CPC .... B60K 2350/1024; B60K 2350/1044; B60K 2350/2052; B60K 35/00; B60K 37/06; B60R 16/0373; B60R 2021/01197; B60R 21/0134; B60R 21/01526; B60J 1/1815; B60J 1/004; B60J 1/10; B60J 1/16; B60J 1/1823; B60J 7/1204; B60J 7/1234; B60J 7/1247; B60J 7/145; B60J 7/202; B60J 7/203; B60J 7/22
USPC ..... 296/216, 146.4, 155, 146.8, 146.1, 61, 296/190.01, 186.07; 49/506, 358, 360, 49/139, 26; 180/167
See application file for complete search history.

(56) References Cited

U.S. PATENT DOCUMENTS 4,501,012 A * 2/1985 Kishi ..... B60R 16/0373 704/275
5,739,746 A * 4/1998 Shaffer ..... B60N 2/002 340/425.5
6,240,347 B1 5/2001 Everhart et al.
(Continued)

FOREIGN PATENT DOCUMENTS

JP 2000356069 A 12/2000
JP 2006028936 A 2/2006
(Continued)

OTHER PUBLICATIONS

Craig Stephan, et al.; "A Magnetorheological Door Check"; SAE International, paper No. 2001-01-0619, Mar. 5, 2001; 1 page.

*Primary Examiner* — Glenn Dayoan
*Assistant Examiner* — Sunsurraye Westbrook
(74) *Attorney, Agent, or Firm* — Jason Rogers; King & Schickli, PLLC

(57) ABSTRACT

A power side door system for a motor vehicle includes a vehicle side door connected to a vehicle body and an actuator for displacing the side door between an open and a closed position. The system further includes a presence sensor to determine a change in presence of an individual in a seat position adjacent the side door. Further, the system includes a controller responsive to the presence sensor to control operation of the actuator. Advantageously the system automatically closes the door either after an individual enters the vehicle and occupies the seat or after an individual vacates the seat and leaves the vehicle.

14 Claims, 3 Drawing Sheets

(56) References Cited

U.S. PATENT DOCUMENTS 6,922,147 B1 * 7/2005 Viksnins ..... B60N 2/002 180/272
7,320,478 B2 1/2008 Gaboury et al.
7,500,711 B1 3/2009 Ewing et al.
7,509,772 B2 3/2009 Ohta et al.
7,686,378 B2 * 3/2010 Gisler ..... E05F 15/43 296/146.4
7,860,625 B2 * 12/2010 Jaramillo ..... B60N 2/002 180/273
8,035,503 B2 * 10/2011 Partin ..... G08G 1/205 340/426.1
8,296,007 B2 10/2012 Swaminathan et al.
8,577,588 B2 * 11/2013 Dagenais ..... B60T 8/1706 701/1
8,577,855 B2 * 11/2013 Shyam ..... G06F 17/30171 707/704
8,594,616 B2 11/2013 Gusikhin et al.
9,007,031 B2 * 4/2015 Chorian ..... H02J 7/1423 320/136
2004/0090083 A1 * 5/2004 Greuel ..... E05F 15/70 296/146.4
2007/0266635 A1 * 11/2007 Sugiura ..... E05F 15/632 49/27
2009/0048742 A1 * 2/2009 Kiridena ..... G09B 9/05 701/49
2009/0249699 A1 * 10/2009 Yulkowski ..... E05F 15/00 49/349
2011/0275321 A1 * 11/2011 Zhou ..... H04M 1/6091 455/41.2
2013/0234736 A1 * 9/2013 Ootaka ..... G01R 27/2605 324/679
2013/0307684 A1 * 11/2013 Pallotta ..... H04M 1/72577 340/539.11

FOREIGN PATENT DOCUMENTS

JP 2008002095 A 2/2008
JP 2013000717 A 1/2013
TR EP 2639389 A2 * 9/2013 ..... E05D 11/06
WO 2013013313 A1 1/2013

* cited by examiner 10
12
14
16
18
20
22
24
26
28
30
32
34
36
37
38
39
40
41
44b
110
B
V

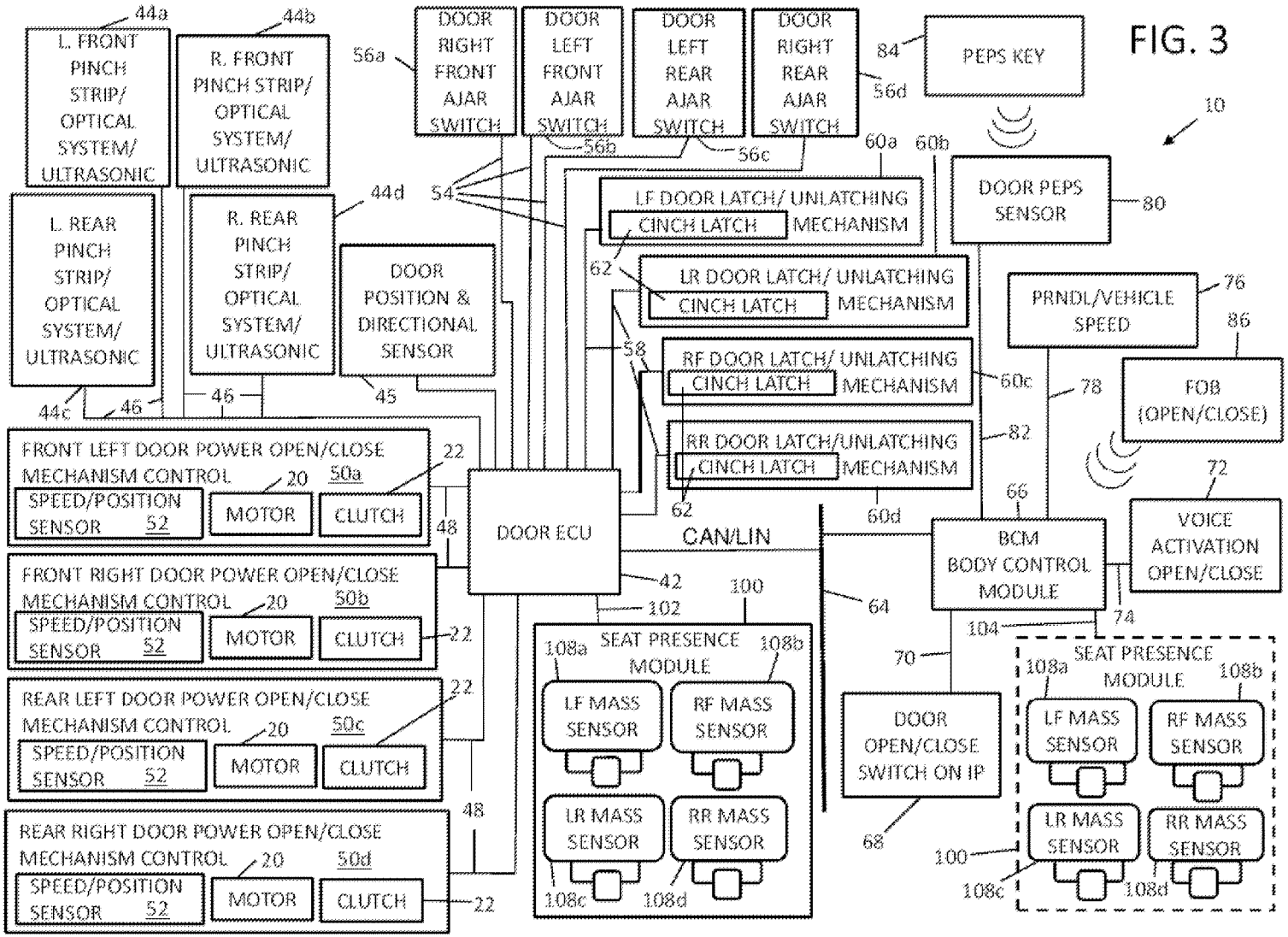
FIG. 3
10
PEPS KEY
84
DOOR PEPS SENSOR
80
PRNDL/VEHICLE SPEED
76
FOB (OPEN/CLOSE)
86
VOICE ACTIVATION OPEN/CLOSE
72
BCM BODY CONTROL MODULE
66
74
78
82
60c
60b
60a
60d
104
70
64
SEAT PRESENCE MODULE
108b
RF MASS SENSOR
RR MASS SENSOR
108a
LF MASS SENSOR
LR MASS SENSOR
108d
108c
100
DOOR OPEN/CLOSE SWITCH ON IP
68
DOOR RIGHT REAR AJAR SWITCH
56d
DOOR LEFT REAR AJAR SWITCH
56c
DOOR LEFT FRONT AJAR SWITCH
56b
DOOR RIGHT FRONT AJAR SWITCH
56a
LF DOOR LATCH/ UNLATCHING MECHANISM
CINCH LATCH
LR DOOR LATCH/ UNLATCHING MECHANISM
CINCH LATCH
RF DOOR LATCH/ UNLATCHING MECHANISM
CINCH LATCH
RR DOOR LATCH/UNLATCHING MECHANISM
CINCH LATCH
62
58
CAN/LIN
42
102
DOOR ECU
54
DOOR POSITION & DIRECTIONAL SENSOR
45
44d
R. FRONT PINCH STRIP/ OPTICAL SYSTEM/ ULTRASONIC
44b
R. REAR PINCH STRIP/ OPTICAL SYSTEM/ ULTRASONIC
46
L. FRONT PINCH STRIP/ OPTICAL SYSTEM/ ULTRASONIC
44a
L. REAR PINCH STRIP/ OPTICAL SYSTEM/ ULTRASONIC
44c
FRONT LEFT DOOR POWER OPEN/CLOSE MECHANISM CONTROL 50a
FRONT RIGHT DOOR POWER OPEN/CLOSE MECHANISM CONTROL 50b
REAR LEFT DOOR POWER OPEN/CLOSE MECHANISM CONTROL 50c
REAR RIGHT DOOR POWER OPEN/CLOSE MECHANISM CONTROL 50d
CLUTCH
MOTOR
20
22
48
SPEED/POSITION SENSOR 52

| CONDITIONS | | | | | COMMANDS/INPUTS | | | | |
|---|---|---|---|---|---|---|---|---|---|
| VEHICLE SPEED / PRNDL POSITION | DOOR POSITION | ULTRA SONIC DOOR SENSOR | PEPS | USER LOCATION | IP SWITCH PULL TO OPEN /PUSH TO CLOSE POWER OPEN /CLOSE | KEYFOB BUTTON PRESS TWICE- POWER OPEN/CLOSE | HANDS FREE OPEN /CLOSE GESTURE CAPACITIVE SENSING VOICE ACTIVATION | OUTSIDE OR INSIDE DOOR HANDLE –PULL TO ACTIVATE POWER UNLATCH & CYCLE | SEAT PRESENCE ACTUATION |
| VEHICLE SPEED NULL / PRNDL = P | CLOSED | ACTIVE - LOOKS FOR OBSTRUCTIONS | PEPS FOUND & IDENTIFIED – VEHICLE DOOR LOCKS NOT REQUIRED. | SEATED - EXITING | PRIMARY - OPEN POSITION ON SWITCH-DOOR TO FULL OPEN LARGEST POSSIBLE ANGLE /ULTRASONIC SENSING | PRIMARY - DOOR TO FULL OPEN LARGEST POSSIBLE ANGLE /ULTRASONIC SENSING | PRIMARY - VOICE "DOOR OPEN" LARGEST POSSIBLE ANGLE / ULTRASONIC SENSING | PRIMARY - DOOR TO FULL OPEN LARGEST POSSIBLE ANGLE / ULTRASONIC SENSING | OVERRIDE – ALLOW ALL OTHER ACTIVATION EXCEPT OUTSIDE DOOR HANDLE |
| VEHICLE SPEED NULL / PRNDL = P | CLOSED | ACTIVE - LOOKS FOR OBSTRUCTIONS | PEPS FOUND & IDENTIFIED – (VEHICLE DOOR LOCKS NOT REQUIRED) | STANDING OUTSIDE | N/A | PRIMARY - DOOR TO FULL OPEN LARGEST POSSIBLE ANGLE /ULTRASONIC SENSING | PRIMARY - VOICE-"DOOR OPEN" LARGEST POSSIBLE ANGLE / ULTRASONIC SENSING | PRIMARY - DOOR TO FULL OPEN LARGEST POSSIBLE ANGLE/ ULTRASONIC SENSING | OVERRIDE – ALLOW ALL OTHER ACTIVATION |
| VEHICLE SPEED NULL / PRNDL = P | OPENED | ACTIVE - LOOKS FOR OBSTRUCTIONS | PEPS FOUND & IDENTIFIED – VEHICLE DOOR LOCKS NOT REQUIRED. | SEATED - ENTERING | SECONDARY – FAULT STATE ACTIVATION ONLY. IF PRIMARY FAILS | SECONDARY – FAULT STATE ACTIVATION ONLY. IF PRIMARY FAILS | SECONDARY - VOICE- "DOOR CLOSE" CLOSES & LATCHES WHILE MONITORING FOR OBSTRUCTIONS THROUGH ULTRASONIC SENSING | SECONDARY-CLOSES & LATCHES WHILE MONITORING FOR OBSTRUCTIONS THROUGH ULTRASONIC SENSING | PRIMARY - ACTIVATED - DOOR CLOSES & LATCHES AUTOMATIC-ALLY |
| VEHICLE SPEED NULL / PRNDL = P | OPENED | ACTIVE - LOOKS FOR OBSTRUCTIONS | PEPS FOUND & IDENTIFIED – VEHICLE DOOR LOCKS NOT REQUIRED. | STANDING OUTSIDE | N/A | PRIMARY – DOOR TO FULL CLOSE & LATCHED POSITION | SECONDARY- VOICE- "DOOR CLOSE" CLOSES & LATCHES WHILE MONITORING FOR OBSTRUCTIONS THROUGH ULTRASONIC SENSING | N/A | PRIMARY – ACTIVATED INTERMEDIATE STATE – WAITING FOR MASS ON SEAT TO CLOSE OR TIME OUT TO CLOSE |
| VEHICLE SPEED NULL / PRNDL = P | OPENED | ACTIVE - LOOKS FOR OBSTRUCTIONS | PEPS FOUND & IDENTIFIED – VEHICLE DOOR LOCKS NOT REQUIRED. | SEATED - EXITING | SECONDARY – FAULT STATE ACTIVATION ONLY. IF PRIMARY FAILS | SECONDARY – FAULT STATE ACTIVATION ONLY. IF PRIMARY FAILS | SECONDARY - VOICE- "DOOR CLOSE" CLOSES & LATCHES WHILE MONITORING FOR OBSTRUCTIONS THROUGH ULTRASONIC SENSING | DON'T DO ANYTHING. | PRIMARY MASS REMOVED DOOR CLOSES & LATCHES IF NO OBSTRUCTIONS FOUND |
| VEHICLE SPEED GREATER THAN 3KPH / PRNDL = ALL BUT PARK | OPENED | ACTIVE - LOOKS FOR OBSTRUCTIONS | PEPS FOUND & IDENTIFIED – VEHICLE DOOR LOCKS NOT REQUIRED | SEATED - DRIVING | SPEED SENSOR CLOSES ALL DOORS | | | | |
| VEHICLE SPEED GREATER THAN 3KPH / PRNDL = ALL BUT PARK | CLOSED | NOT ACTIVE | PEPS FOUND & IDENTIFIED – VEHICLE DOOR LOCKS NOT REQUIRED | SEATED-DRIVING | NO DOOR ACTUATION POSSIBLE THROUGH ANY DEVISE UNLESS CRASH SIGNAL READ THEN ALL ACTIVE. | | | | |

FIG. 4

POWER DOOR SYSTEM FOR A MOTOR VEHICLE

TECHNICAL FIELD

This document generally relates to a power door system for a passenger or motor vehicle.

BACKGROUND

U.S. Pat. No. 7,500,711 to Ewing et al., assigned to Ford Global Technologies, LLC, discloses a power side door for a passenger vehicle. As described the vehicle door is opened and closed by an actuator incorporating a motor, a cooperating clutch and a lead screw that is connected at its distal end to a door check arm.

This document relates to an improvement to such power side door systems wherein an open side door is closed automatically in response to a change in presence or occupancy of the adjacent seat within the motor vehicle.

SUMMARY

An improved power side door system for a motor vehicle comprises a vehicle side door connected to a vehicle body, an actuator for displacing the side door between an open position and a closed position and a presence sensor to determine a change in presence or occupancy of an individual in a seat position adjacent the side door. A controller responsive to the presence sensor controls operation of the actuator.

In one embodiment, the system includes an obstacle sensor for sensing an obstacle in the path of movement of the side door. The controller is responsive to the obstacle sensor to control operation of the actuator. In this way it is possible to prevent contact between the side door and the obstacle such as an adjacent vehicle.

The system may further include a switch for selectively displacing the door between the open position and the closed position. The controller is responsive to the switch to control operation of the actuator. The system may also include a force sensor for sensing an opening or closing force applied to the side door. The controller is responsive to the force sensor to control operation of the actuator. Still further the system may include a door handle sensor for sensing operation of a door handle to release a latch that secures the side door in the closed position. The controller is responsive to the door handle sensor to control operation of the actuator. Further, the system may include a voice activation module for recognizing spoken sounds. The controller is responsive to the voice activation module to control operation of the actuator and open and close the side door in response to voice commands.

In one embodiment of the invention, the presence sensor is a weight sensor connected to the seat. In one embodiment the actuator is a linear actuator carried in the side door. In one possible embodiment the system includes a door check arm having a first end pivotally connected to the linear actuator and a second end pivotally connected to the vehicle body. The door check arm may be smooth to provide an infinite number of stop positions. Further the side door may include a guidance roller system for engaging the door check arm. The roller system includes opposed rollers engaging opposite sides of the door check arm. In yet another embodiment, the door system includes a power latch having an engaged position for securing the side door in the closed position and an unengaged position for releasing the side door for opening.

In accordance with another aspect, a vehicle is provided incorporating the power side door system.

In accordance with yet another aspect, a method is provided for operating a power side door. That method comprises the steps of opening the power side door, monitoring the seat adjacent the side door by means of a presence sensor and then closing the side door by operation of an actuator in response to a controller either after (a) an individual enters the vehicle and occupies the seat or (b) an individual vacates the seat and leaves the vehicle as determined by detection of a change of presence in the seat by the presence sensor. Still further the method may include monitoring the seat for a change in presence for a predetermined time frame and automatically closing the power side door in response to detection of a change of presence in the seat during that predetermined time frame. In one embodiment the predetermined time frame is started upon opening the door. In one embodiment the method includes sensing weight in the seat in order to determine a change of presence in the seat. In one embodiment the method includes setting a predetermined minimum weight to establish presence of an individual in the seat.

In the following description, there is shown and described several preferred embodiments of the power side door system for a motor vehicle. As it should be realized, the power side door system for a motor vehicle is capable of other, different embodiments and its several details are capable of modification in various, obvious aspects all without departing from the system as set forth and described in the following claims. Accordingly, the drawings and descriptions should be regarded as illustrative in nature and not as restrictive.

BRIEF DESCRIPTION OF THE DRAWINGS

The accompanying drawings incorporated herein and forming a part of the specification, illustrate several aspects of the power side door system and together with the description serve to explain certain principles thereof. In the drawings:

FIG. 3 is an electrical block diagram for the power side door system; and

FIG. 4 is a seat actuation function diagram or table.

Figures 1, 2:
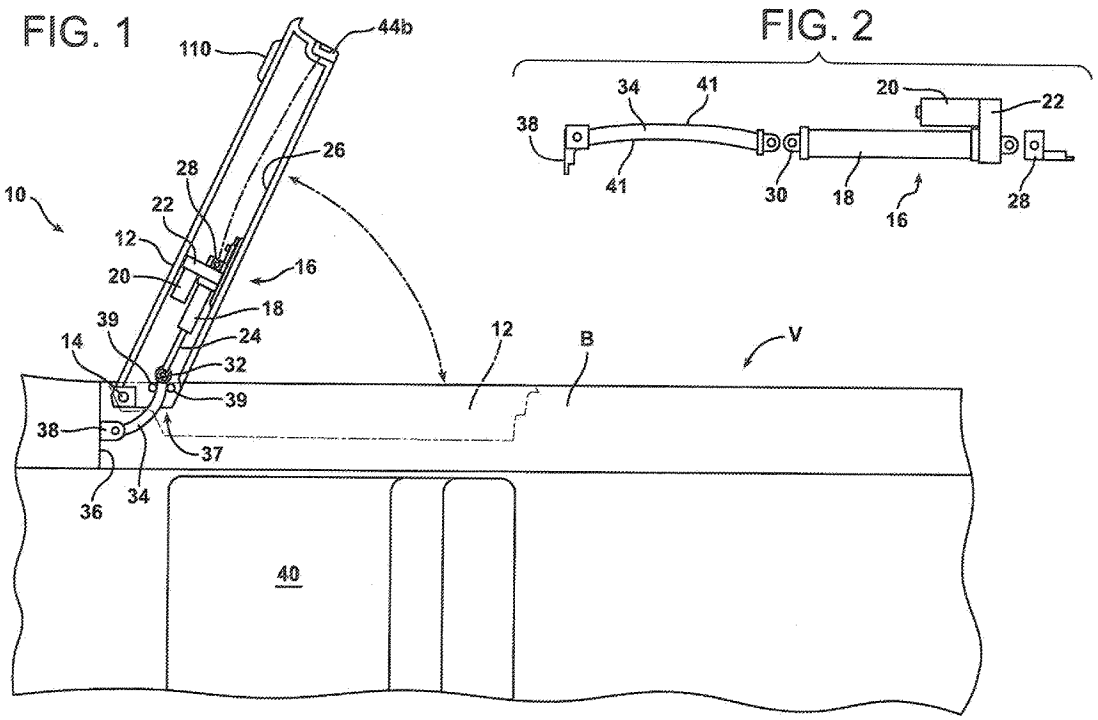
FIG. 1 is a schematic top plan view showing a power side door of a motor vehicle in an open position.
FIG. 2 is an exploded top plan view of the power side door actuator, check arm and mounting brackets.

Reference will now be made in detail to the present preferred embodiments of the power side door system, examples of which are illustrated in the accompanying drawings.

DETAILED DESCRIPTION

Reference is now made to FIGS. 1-3 illustrating the power side door system 10 for a motor vehicle V. In the illustrated embodiment the side door 12 is pivotally mounted to the vehicle body B by means of a hinge 14 which allows the side door to be displaced between a fully opened position (illustrated in full line) and a fully closed position illustrated in phantom line.

The side door 12 is displaced between the open and closed positions by means of an actuator generally designated by reference numeral 16. In the illustrated embodiment the actuator 16 comprises a housing 18, an electric drive motor 20, a transmission and clutch 22 and a lead screw 24. The housing 18 is mounted to the interior wall 26 of the side door 12 by means of the mounting bracket 28. The distal end 30 of the lead screw 24 is pivotally connected by a pin 32 to one end of a door check arm 34. The opposite end of the door check arm 34 is pivotally mounted to the support 36 of vehicle body B by means of the bracket 38.

As further illustrated in FIG. 1, a guidance roller system, generally designated by reference numeral 37, is mounted in the door 12. The guidance roller system 37 includes opposed rollers 39 that roll along and follow opposite side edges 41 of the check arm 34 (see also FIG. 2). If desired an additional set of opposing rollers (not shown) engage and follow the upper and lower faces of the check arm 34. As should also be appreciated, the check arm 34 may include smooth edges 41 and faces to allow for an infinite number of stopping positions. When the motor 20 is driven in one direction, rotational motion of the motor is converted through the transmission and clutch 22 to a linear motion and the lead screw 24 is extended from the housing 18 to open the door 12. In contrast, when the motor 20 is driven in the opposite direction, the lead screw 24 is retracted into the housing 18 and the door 12 is closed. When the door 12 is open it allows access to the adjacent seat 40 through the opening created in the side of the vehicle V. Additional details respecting the actuator 16 may be found in U.S. Pat. No. 7,500,711 to Ewing et al.

Reference is now made to FIG. 3 which is an electrical block diagram for the power side door system 10. The heart of the system 10 is the door electronic control unit (ECU) or controller 42 (e.g. a computing device with a processor and a memory). As should be appreciated the controller 42 is connected by appropriate buses, cables and control lines to various sensors and other components in order to allow proper operation of the power side door system 10. Thus, as illustrated, the controller 42 is connected to the left front door pinch strip/optical system/ultrasonic sensor 44*a*, the right front door pinch strip/optical system/ultrasonic sensor 44*b*, the left rear door pinch strip/optical system/ultrasonic sensor 44*c* and the right rear door pinch strip/optical system/ultrasonic sensor 44*d* by means of control lines 46. The pinch strip/optical system/ultrasonic sensors 44*a*-44*d* are effective to sense and detect obstructions in the path of a door 12 as it is opened and closed in a manner known in the art.

The controller 42 is also connected by control lines 48 to the individual door power open/close mechanism controls 50*a*-50*d*. Each door power mechanism control 50*a*-50*d* includes the actuator 16 with the drive motor 20, the transmission and clutch 22 as well as a speed/position sensor 52. As noted above, the motor 20 and clutch 22 allow control of the individual actuators 16 that open and close each door 12.

The controller 42 is also connected by means of control lines 54 to the door right front ajar switch, door left front ajar switch, door left rear ajar switch and door right rear ajar switch 56*a*-56*d*. These switches 56*a*-56*d* detect when one of the doors 12 is slightly ajar and provide an appropriate signal through the control lines 54 to the controller 42.

As further illustrated in FIG. 3, the controller 42 is also connected through the control lines 58 to a left front door latch/unlatching mechanism, a left rear door latch/unlatching mechanism, a right front door latch/unlatching mechanism and the right rear door latch/unlatching mechanism 60*a*-60*d*. Each door latch/unlatching mechanism 60*a*-60*d* includes an electrical cinch latch 62 that may be activated to latch and unlatch each door 12 when in the closed position in a manner known in the art.

As further illustrated in FIG. 3, the controller 42 is connected via the bus 64 to the body control module 66. The body control module 66 functions to provide the vehicle V with an interactive information, diagnostic, entertainment and both wired and wireless communication system in the nature described in, for example, U.S. Pat. No. 6,240,347 to Everhart et al. and known in the marketplace as the FORD SYNC system.

As illustrated, the body control module 66 is connected to the door open/close switch 68 by control line 70, voice activation or speech processor module 72 by control line 74, transmission and vehicle speed sensors 76 by control line 78 and door "passive entry passive start" (PEPS) sensor 80 by control line 82. As further illustrated, body control module 66 is connected by wireless communication to a passive entry passive start key 84 and/or a passive entry passive start fob 86.

As further illustrated in FIG. 3, in one possible embodiment a seat presence module 100 is connected to the controller 42 through the control line 102. In an alternative embodiment the seat presence module 100 is connected via control line 104 to the body control module 66 (note dash lined illustration in drawing FIG. 3). In the illustrated embodiment the seat presence module 100 includes presence, weight or mass sensors 108*a*-108*d*: one such sensor being located on each of the four seats 40 adjacent the individual side doors 12 of the vehicle V. The seat presence module 100 determines the presence or occupancy of an individual in a seat position adjacent each of the side doors 12.

A seat actuation function diagram or table is presented in FIG. 4. This diagram illustrates the operation of the side door system 10 in response to various conditions and commands/inputs.

As should be appreciated, through operation of the controller 42 in response to input from the various sensors and switches described, the side door system 10 is responsive to the needs of PEPS authorized individuals seeking to enter and exit the vehicle V. As should be appreciated, any of the vehicle doors 12 may be opened or closed in response to a voice command received through the voice activation module or speech processor 72. Thus, for example, someone sitting in the front passenger seat 40 may speak the phrase "open front right door" and the door will be opened in response thereto by the controller 42 so long as other system defeat conditions are met including, for example, vehicle speed=0/vehicle transmission in park and passive entry passive start key has been found and identified. In such an instance, the cinch latch for the door 12 is operated to unlatch the door and the motor 20 is operated to extend the lead screw 24 and open the door 12. The door 12 is fully opened as illustrated in FIG. 1 unless the obstacle sensor 44*b* senses an obstacle in which case a signal is sent to the controller 42 and the controller 42 then deactivates the motor 20 prior to the door contacting the obstacle. After exiting the vehicle through the open door 12, an individual may announce the voice command "close right front door", press the door toward a closed position (as detected by door position and direction sensor 45 such as a force sensor) or push a button on the key fob 86 and the door 12 will then close with the obstruction sensor 44*b* again monitoring for any obstruction that might prevent closure.

Advantageously, the power side door system 10 also allows for automatic closing of the power side door 12 by operation of the actuator 16 in response to the controller 42 either after (a) an individual enters the vehicle V and occupies the seat 40 adjacent the door or (b) an individual vacates the seat and leaves the vehicle as determined by detection of a change of presence in the seat by the seat presence module 100. More specifically, when an individual is inside the vehicle in the seat 40, the individual may, for example, open the door by touching/pulling the interior door handle (not shown), actuating the door open switch 68 or providing a voice command/actuation request for the door to open. During the opening process, the seat presence module 100 monitors presence or absence of an individual in the seat 40. This, for example, may be done by means of a weight sensor 108*b*. As should be appreciated the weight sensor 108*b* may operate alone or in conjunction with other occupant classification sensors such as infrared, vision, ultrasonic, radar or lidar based sensors, pizo electric sensors, pizo resistive sensors, charge couple devices, photo diodes, pressure sensors, strain gauges or in some other form known in the art. The sensors may be provided in various locations within the vehicle to sense the presence or absence of an individual in the seat 40 or other object such as a car safety seat.

In one possible embodiment the sensor is a weight sensor 108*a*-108*d* set with a predetermined minimum weight to establish the presence of an adult individual in the seat 40 as distinguished from a child. Thus, for example, the predetermined minimum weight may be set at, for example, 40, 45, 50, 55, 60, 65, 70, 75, 80 or 85 pounds. Unless the weight in the seat exceeds the predetermined minimum value, the automatic door close feature provided by the seat presence module 100 coupled to the seat 40 is deactivated thereby effectively functioning as a child safety lock.

In the example being described, the weight sensor 108*b* of the seat presence module 100 detects the weight of an individual adult in the seat 40 as the door 12 is being opened by the actuator 16. Monitoring continues for a predetermined time frame (e.g. 10, 15, 20, 25, 30, 35, 40, 45 or more seconds). During that time frame the weight sensor 108*b* of the seat presence module 100 monitors the weight in the seat 40 in order to detect any change of presence occupancy in the seat. As the individual rises from the seat 40 and leaves the vehicle V through the open door 12, weight sensor 108*b* of the module 100 detects the change in weight indicating that the seat is now unoccupied. In the full line embodiment illustrated in FIG. 3, this change in presence with respect to the seat 40 is signaled to the door controller 42 through the control line 102. In the alternative, dashed line embodiment, this change in presence with respect to the seat 40 is communicated from the seat presence module 100 to the body control module 66 through the control line 104 and then from the body control module to the door controller 42 through the bus 64.

Upon receiving a change in presence signal, the controller 42 waits a predetermined length of time (e.g. 5 seconds, 10 seconds, 15 seconds, 20 seconds) and then automatically sends a signal through the control line 48 to the front right door power open/close mechanism control 50*b* which activates the motor 20 and operates the clutch 22 to cause the door 12 to automatically close without any further input from the operator. As should be appreciated, the obstacle sensor 44*b* monitors the path of the door 12 during the closing operation to ensure no obstacle is in the way of the door as it closes.

When an individual is outside the vehicle V and seeks entry, he may initiate opening of the door by (a) pressing a button on the fob 86, (b) providing for voice actuation through the voice activation module 72, (c) engaging the door handle 110, (d) performing a physical gesture within the proximity of a gesture sensor or some combination thereof. In response, the controller 42 signals the right front door latch/unlatching mechanism 60*c* that operates the cinch latch 62 to unlatch the door 12. An additional signal is sent from the controller 42 through the control line 48 to the front right door power open/close mechanism control 50*b*. This activates the motor 20 to extend the lead screw 59 from the housing 18 and open the door 12. As the door 12 is opened, the right front obstruction sensor 44*b* ensures that no obstacles are in the path of the door 12. If an obstacle is detected, door opening is defeated before the door 12 makes contact with the obstacle. As the door 12 is opened, the right front weight or mass sensor 108*b* of the seat presence module 100 monitors for a change of presence in the adjacent seat 40. In this example the seat is empty as the door 12 is opened.

After the door 12 is opened the individual enters the vehicle V through the open door and sits in the seat 40. In this example the individual entering the vehicle is an adult with a weight over the predetermined minimum thereby making the open/close seat presence control circuit active. The seat presence module 100 monitors the seat 40 for a change in presence for the designated predetermined period of time. Upon detecting the presence of the individual in the seat 40 by detection of weight over the minimum value, a signal is sent from the mass sensor 108*b* of the seat presence module 100 directly to the door controller 42 through the control line 102 (or in the alternative embodiment to the body control module 66 through the control line 104 which communicates that signal to the door controller 42 through the bus 64).

Upon receiving the signal from the module 100, the door controller 42 sends a control signal through the line 48 to the front right door power open/close mechanism control 50*b* directing that the door 12 be closed. In response the motor 20 is activated. The motor 20 drives the lead screw 24 through the clutch and transmission 22 so that the lead screw is retracted into the housing 18 thereby closing the door 12. Throughout the closing operation the right front pinch strip/optical system/ultrasonic obstruction sensor 44*b* monitors door movement to ensure that the door 12 is free to be closed. If so programmed, upon the closing of the door 12, the controller 42 sends a control signal through the line 58 to the right front door latch/unlatching mechanism 60*c*, activating the cinch latch 62 to lock the door. Thus, it should be appreciated that the new system can effectively eliminate the need of providing the vehicle with a manual door locking switch as this may all be done automatically each time the door is closed.

In the event there is no change in presence detected by the seat presence module 100 during the predetermined time frame, there is no automatic activation to close the door.

In summary, numerous benefits result from applying the concepts disclosed herein. More specifically, a power side door system 10 is provided for a motor vehicle V that provides for automatic closing of the door 12 either after (a) an individual enters the vehicle and occupies the adjacent seat 40 or (b) an individual vacates the seat and leaves the vehicle as determined by detection of a change in presence or occupancy in the seat by the seat presence module 100. Thus, there is no need for the user to take any additional action to activate door closing. Thus, the hands of the individual are free and entry into and exit from the vehicle V are made simple and more convenient. The automatic closing feature described herein is particularly appreciated in inclement weather conditions when the operator might otherwise have to handle a wet, snowy or icy door surface in order to close the door.

The foregoing has been presented for purposes of illustration and description. It is not intended to be exhaustive or to limit the embodiments to the precise form disclosed. Obvious modifications and variations are possible in light of the above teachings. For example, in one possible embodiment, the seat presence module 100 uses or shares components of the vehicle's smart airbag system such as described in U.S. Pat. No. 7,320,478 to Gaboury et al. (assigned to Ford Global Technologies LLC). All such modifications and variations are within the scope of the appended claims when interpreted in accordance with the breadth to which they are fairly, legally and equitably entitled.

What is claimed:

1. A power side door system for a motor vehicle, comprising:

a vehicle side door connected to a vehicle body;

an actuator for displacing said side door between an open position and a closed position;

a presence sensor to determine a change in presence of an individual in a seat position adjacent said side door;

a controller responsive to said presence sensor to control operation of said actuator; and a cinch latch having an engaged position for securing said side door in said closed position and an unengaged position for releasing said side door for opening.

2. The system of claim 1, further including an obstacle sensor for sensing an obstacle in a path of movement of said side door, said controller being responsive to said obstacle sensor to control operation of said actuator.

3. The system of claim 2, further including a voice activation module for recognizing spoken sounds, said controller being responsive to said voice activation module to control operation of said actuator and open and close said side door in response to voice commands.

4. The system of claim 2, further including a switch for displacing said door between said open position and said closed position, said controller being responsive to said switch to control operation of said actuator.

5. The system of claim 4, further including a force sensor for sensing an opening or closing force applied to said side door, said controller being responsive to said force sensor to control operation of said actuator.

6. The system of claim 5, further including a door handle sensor for sensing operation of a door handle to release a latch that secures said side door in said closed position, said controller being responsive to said door handle sensor to control operation of said actuator.

7. The system of claim 6, further including a voice activation module for recognizing spoken sounds, said controller being responsive to said voice activation module to control operation of said actuator and open and close said side door in response to voice commands.

8. The system of claim 1, wherein said presence sensor is a weight sensor connected to said seat.

9. The system of claim 1, wherein said side door includes a pivot hinge that connects said side door to said vehicle body.

10. The system of claim 1, wherein said actuator is a linear actuator carried in said side door.

11. The system of claim 10, further including a door check arm having a first end pivotally connected to said linear actuator and a second end pivotally connected to said vehicle body.

12. The system of claim 11 wherein said door check arm is smooth to provide an infinite number of stop positions.

13. The system of claim 12, wherein said side door further includes a guidance roller system for engaging said door check arm, said roller system including opposed rollers engaging opposite sides of said door check arm.

14. A vehicle incorporating said power side door system of claim 1.

* * * * *